US006231257B1

(12) United States Patent
Stevens

(10) Patent No.: US 6,231,257 B1
(45) Date of Patent: May 15, 2001

(54) MARKING INSTRUMENTS

(75) Inventor: Christopher John Stevens, Reading (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/391,553

(22) Filed: Sep. 8, 1999

(30) Foreign Application Priority Data

Sep. 14, 1998 (GB) ..... 9820017

(51) Int. Cl.[7] ..... B43K 24/02
(52) U.S. Cl. ..... 401/108; 401/107
(58) Field of Search ..... 401/107, 108, 401/99, 100, 102, 103, 109, 117

(56) References Cited

U.S. PATENT DOCUMENTS 3,525,573 * 8/1970 Fend ..... 401/108
4,711,592 * 12/1987 Gregory ..... 401/108
4,969,764 * 11/1990 Gregory ..... 401/108
5,823,697 * 10/1998 Talbot ..... 401/108

* cited by examiner

*Primary Examiner*—David J. Walczak
(74) *Attorney, Agent, or Firm*—Marshall, O'Toole, Gerstein, Murray, & Borun

(57) ABSTRACT

A marking instrument includes a barrel, a marking tip and a marking fluid reservoir disposed in the barrel, a retraction mechanism to move the marking tip from an operable position to a retracted position through an opening in the barrel, and a seal to close off the marking tip from the barrel opening when the marking tip is retracted. The seal is toroidal in shape, which allows the seal to close upon itself, thereby eliminating any need for additional manipulation or outside forces to close the seal. The marking tip, marking fluid reservoir and seal are replaceable so that each can be replaced when they become worn or inoperable.

18 Claims, 5 Drawing Sheets

MARKING INSTRUMENTS

This invention relates to marking instruments and in particular it relates to so-called retractable marking instruments of the kind having a barrel into which a replaceable refill unit is fitted, the refill unit including a marking tip and a reservoir for marking fluid to be supplied to the tip, and a retraction mechanism operable by the user for moving the marking unit between advanced and retracted positions for displacing the marking tip either to project through the forward end of the barrel to enable the marking instrument to be used, or to be withdrawn into the barrel so that the tip is enclosed during periods of non-use.

Retractable marking units, in particular retractable ball point pens, have been known and used for many years. However, as a special seal arrangement is needed to seal around the retracted tip if the tip is of a kind from which fluid tends to dry out during periods of non-use, the use of retractable pens has been mostly restricted to ball point pens which use viscous ink and do not suffer from dry out problems. Various proposals have been made to incorporate a sealing arrangement at the forward end of the barrel for sealing around the retracted tip to prevent tip dry out, but such arrangements generally suffer drawbacks of being complicated in construction or operation and/or being incapable of ensuring a reliable sealing function over long term use of the writing instrument, during which term the refill unit may be replaced several times.

The present invention addresses these limitations and as a solution it provides a marking instrument comprising a barrel, a marking unit including a marking tip and marking fluid reservoir disposed in the barrel and replaceable therein, a retraction mechanism for advancing and retracting the marking unit for moving the marking tip between a writing position projecting through an opening at the forward end of the barrel and an inoperative position within the barrel, a seal for closing off the retracted marking tip from the barrel opening when the marking tip is retracted, and wherein the seal is replaceable within the barrel with a removable seal holder.

By providing a seal which is readily replaceable, an effective seal at the forward end of the barrel can be ensured for the entire useful lifetime of the marking instrument by replacing the seal at appropriate intervals, such as each time the marking unit is replaced. Thus, when purchasing a refill unit for the marking instrument a customer may acquire with the refill unit a new seal to replace that previously fitted to the marking instrument.

In accordance with another aspect, therefore, the invention provides a refill unit for a marking instrument in accordance with the invention as described above, the refill unit comprising a marking tip and a reservoir containing marking fluid for delivery to the marking tip, and a sealing device which is arranged to seal around the marking tip when the sealing device and refill unit are installed in a marking instrument.

Conveniently the sealing device will serve to seal around the marking tip both before the refill unit is installed into the marking instrument, in particular within the packaging in which the refill unit and sealing device are supplied to a customer, and after the refill unit and sealing device have been inserted into the marking instrument.

The seal may be a simple sealing member of annular configuration, the preferred form of seal being one which is adopted to roll to and fro within a seal holder cavity as the marking tip is advanced and retracted through the seal. The most preferred forms of seals are those described in our copending International Patent Application No. PCT/US98/05688, to which reference should be made for a clear understanding of the form of the seal and the way in which it cooperates with the marking tip for closing off the tip from ambient atmosphere to prevent marking fluid drying out from the tip. The present invention may be embodied with each and every one of the particular seal arrangements described in the aforementioned International application the contents of which should be taken as incorporated herein by reference.

Some particular embodiments of the invention will now be described with reference to the accompanying drawings in which.

Figure 1:
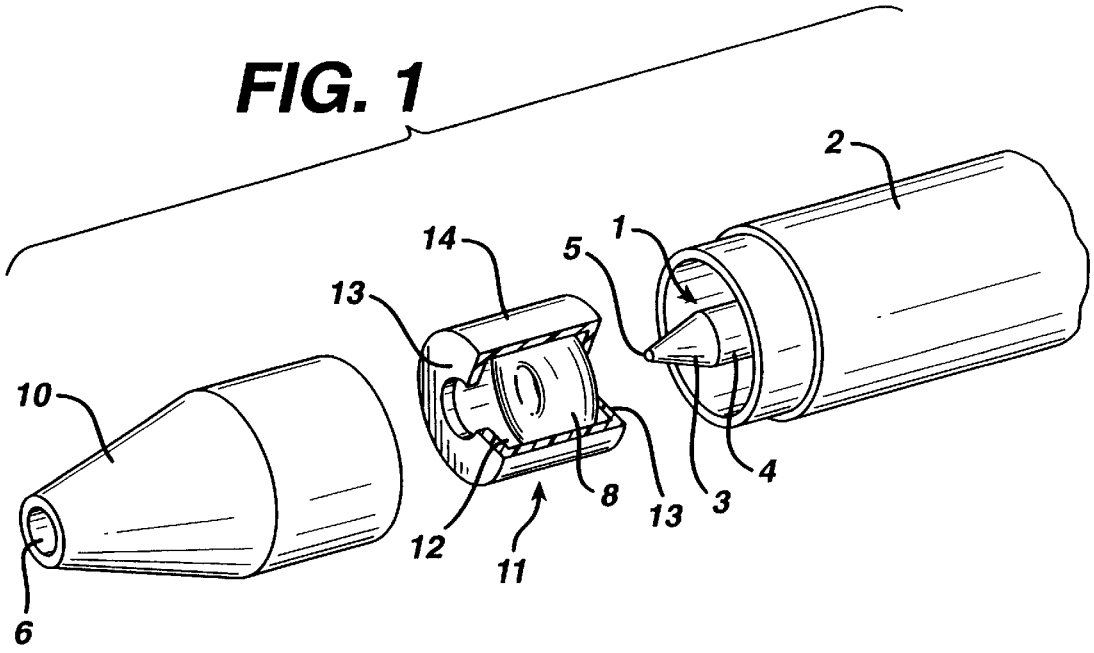
FIG. 1 is a partially cut-away isometric view of the front end part of a first embodiment of a retractable pen according to the invention.

All the embodiments illustrated in the drawings are retractable pens in which a replaceable refill unit 1 is received in a pen barrel 2 equipped with a retraction mechanism for advancing and retracting the refill unit. The particular form of the retraction mechanism 40, is not important and known retraction mechanisms will be suitable. As also generally well known, the refill unit defines a reservoir containing marking fluid, i.e. ink, to be delivered to the marking tip 3 which is provided at the front end of a stem portion 4 of the refill unit and which in the illustrated embodiments comprises a writing ball 5 for laying down the ink during writing. When the refill unit 1 is advanced by the retraction mechanism the tip 3 is projected through the opening 6 at the forward end of the barrel 2, and when the unit is retracted the tip 3 is withdrawn into the barrel.

Figure 2:
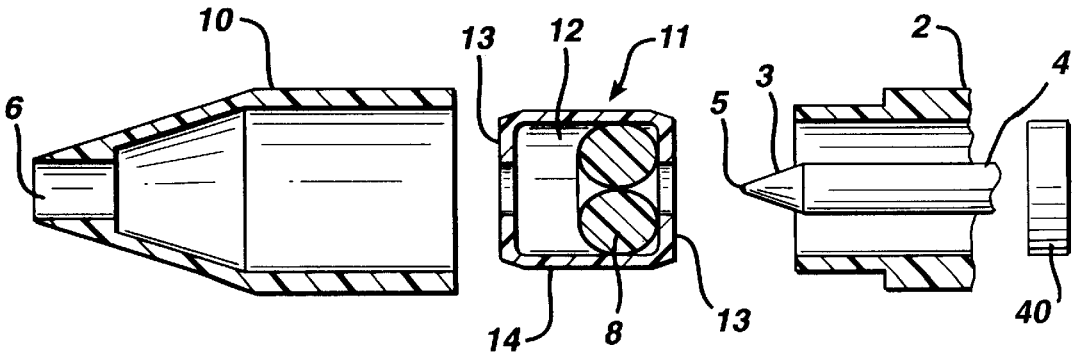
FIG. 2 is an axial section through the embodiment of FIG. 1.

Referring specifically to FIGS. 1 and 2, there is shown an embodiment of a retractable pen in which the barrel 2 includes an easily detachable nose cone portion 10 at the forward end of the barrel. The nose cone 10 may be attached to the main section of the barrel by a threaded connection, a bayonet-type connection or any other convenient form of releasable connection. Removably accommodated within the hollow interior of the nose cone 10 is a sealing device 11 comprising a toroidal seal 8 housed within a cavity 12 defined by a seal holder 14. The seal holder is cylindrical with end walls 13 defined by inturned end flanges to form stops to limit the rolling movement of the seal 8 within the holder. For full details of the seal reference should be made to the pending international patent application mentioned above. When the pen is assembled, the seal holder 14 is held between the nose cone 10 and the front end of the main section of the barrel 2. When the writing tip 3 is retracted, the seal 8 engages the tip 3 and thereby closes off communication between the tip and the barrel opening 6. By uncoupling the detachable nose cone 10, the sealing device 11 is readily removable and replaceable, e.g. whenever the refill unit is replaced, to ensure long term effectiveness of the seal arrangement within the writing instrument.

Figure 3:
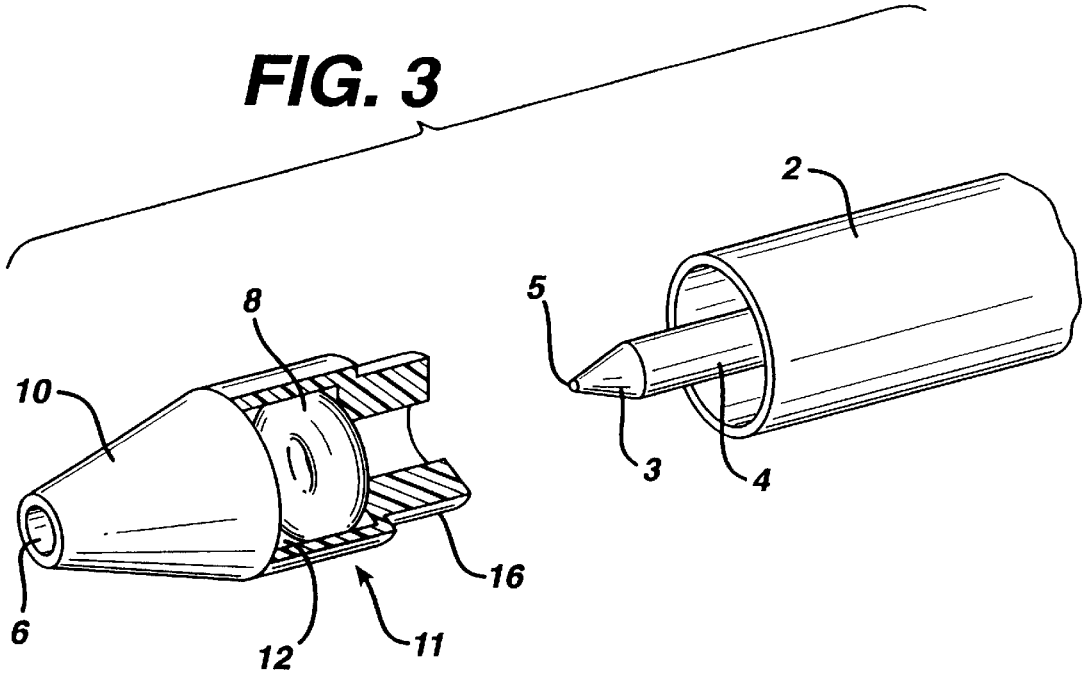
FIG. 3 is a partially cut-away isometric view of a second embodiment.
Figure 4:
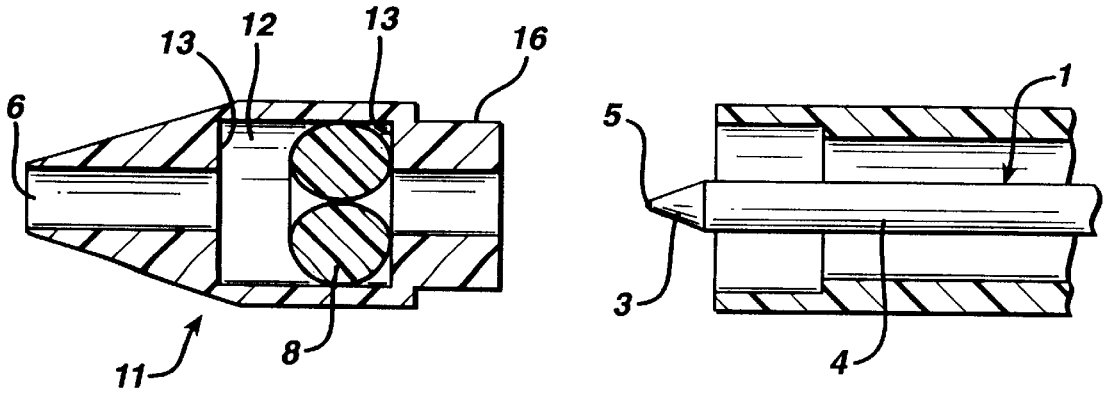
FIG. 4 is an axial section through the second embodiment.

In the embodiment shown in FIGS. 3 and 4, the detachable nose cone 10 serves as the seal holder and defines a cavity 12 with end walls 13 and within which the toroidal seal 8 is accommodated, the nose cone 10 and seal 8 forming a detachable and replaceable sealing device 11. As shown the nose cone 10 has a rear spigot 16 which screws into, or is otherwise releasably connected to the forward end of the main section of the barrel 2. The seal 8 is arranged to seal the writing tip 3 as in the previous embodiment.

Figure 5:
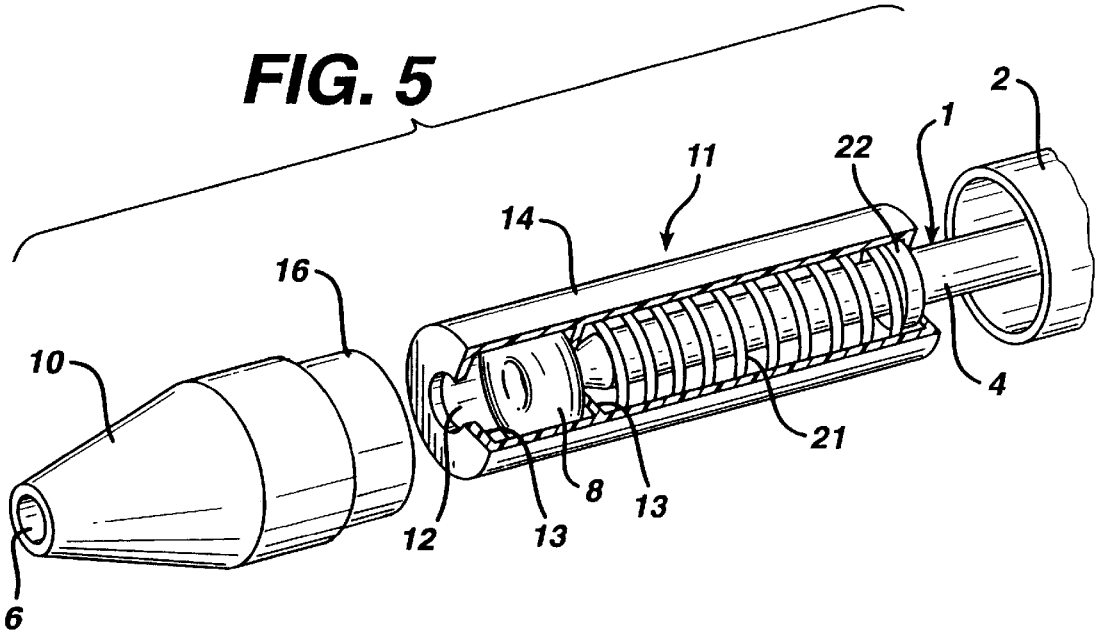
FIG. 5 is a partially cut-away isometric view of a third embodiment.
Figure 6:
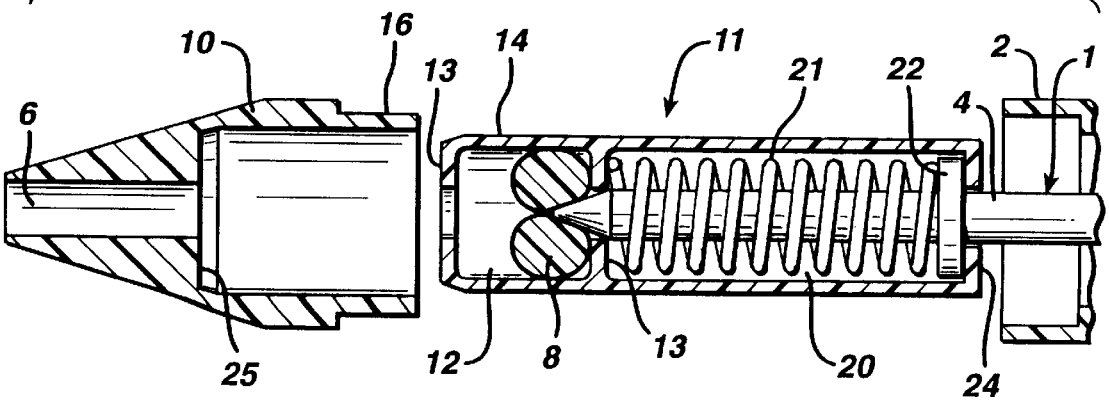
FIG. 6 is an axial section through the third embodiment.

The retractable pen of FIGS. 5 and 6 has a detachable nose cone 10 and a replaceable sealing device 11 comprising a seal holder 14 and seal 8 as in the embodiment of FIGS. 1 and 2. However, the seal holder 14 includes a rearward extension defining a spring chamber 20 accommodating a return spring 21. The front end of the spring is supported against a rearwardly facing shoulder defined by the rear end wall 11 of the seal cavity, and the rear end of the spring acts against a flange formed by a disc 22 fixed to the stem 4 of the refill unit 1 so that, in the assembled writing instrument, the spring 21 urges the seal holder 14 forwardly against an abutment face 25 within the nose cone 10, and urges the refill unit 1 rearwardly for displacing the refill unit from the advanced to the retracted position when the retraction mechanism is operated to retract the writing tip. The flange disc 22 is held captive within the spring chamber 20 by an inturned rear end flange 24 on the seal holder, and as a consequence the sealing device 11 comprising the seal holder 14 and seal 8, as well as the return spring 21, is pre-assembled with the refill unit and is replaceable in the pen barrel as a sub-assembly with the refill unit. The seal 8 can serve to close off the writing point 3 from ambient atmosphere before the refill unit is inserted into the pen barrel, for example while still within the packaging in which the refill unit is sold to a customer. Although the nose cone 10 is shown to be detachable for replacing the refill unit I and sealing device 11, they could be insertable through a rear end of the main section of the barrel which, in a manner known per se, may be disconnectable from a rear barrel section incorporating the retraction mechanism.

Figure 7:
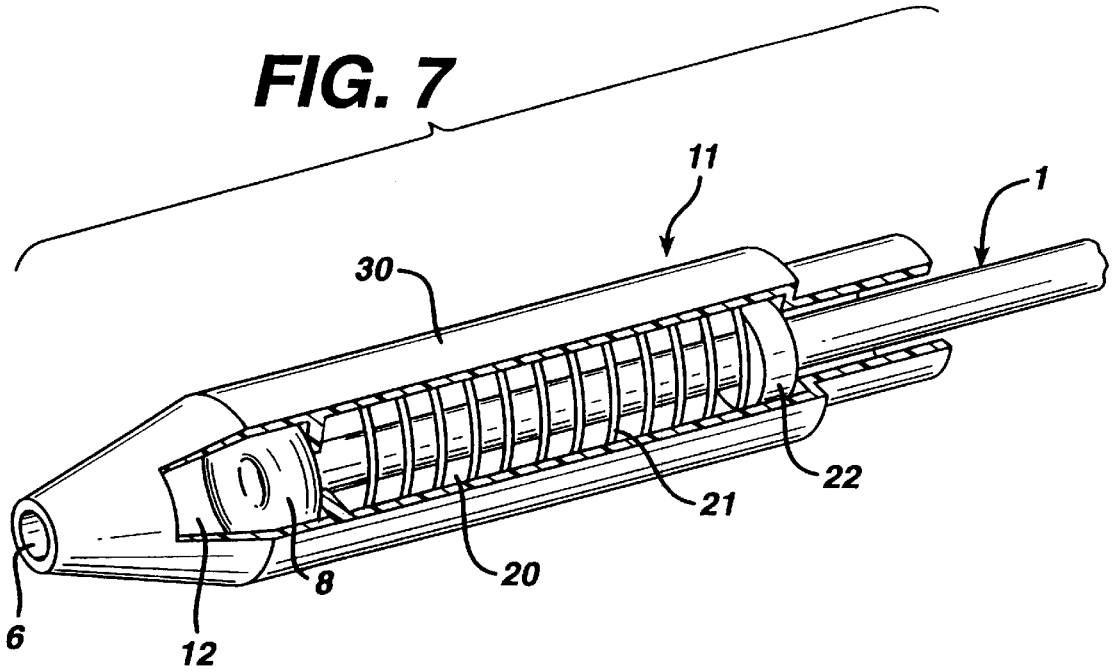
FIG. 7 is a partially cut-away isometric view showing a fourth embodiment of the invention.
Figure 8:
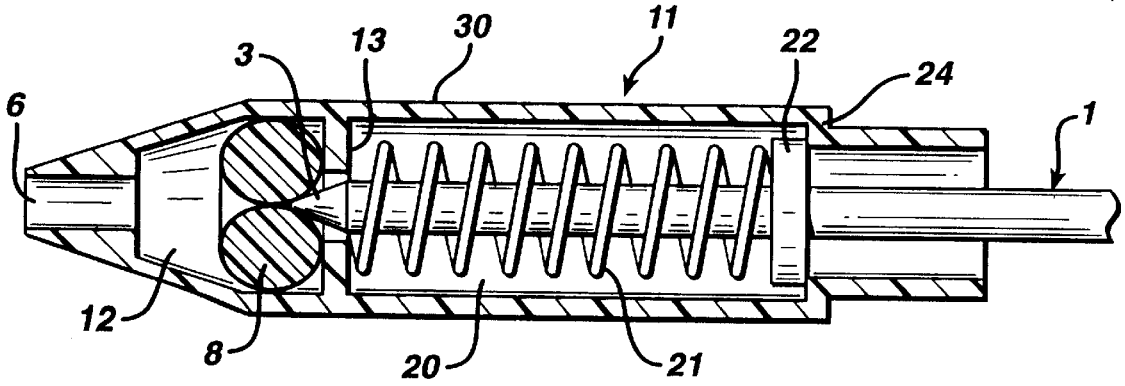
FIG. 8 is an axial section through the fourth embodiment.

The retractable pen of FIGS. 7 and 8 is essentially the same as that of FIGS. 6 and 7 but differs in that the seal holder 14 defining the seal cavity 12 and the spring cavity 20 is formed by a detachable front end portion 30 of the barrel so that this barrel portion becomes replaced with the refill unit 1 and seal 8.

Figure 9:
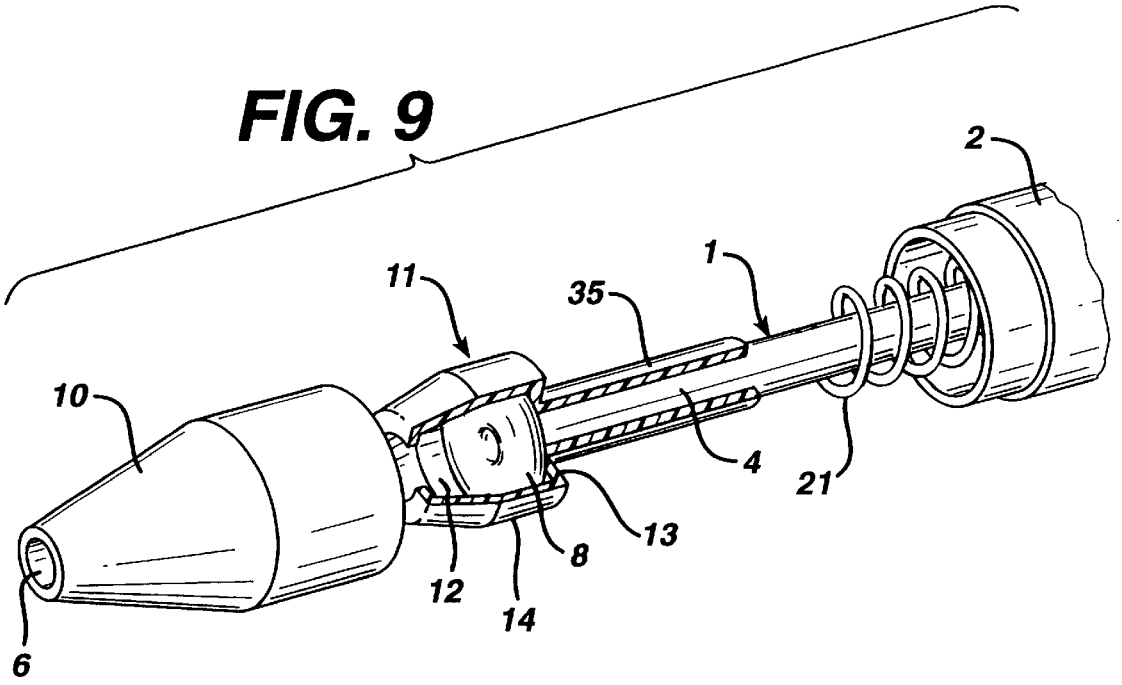
FIG. 9 is a partially cut-away isometric view of a fifth embodiment of the invention.
Figure 10:
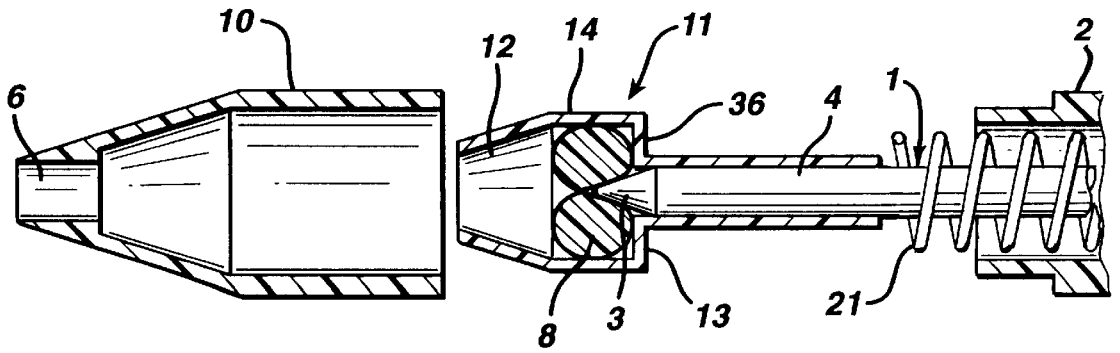
FIG. 10 is an axial section through the fifth embodiment.

In the retractable pen illustrated in FIGS. 9 and 10, the barrel nose cone section 10 is detachable for replacement of the sealing device 11 which in this embodiment comprises a seal holder 14 defining a cavity 12 in which the toroidal seal 8 is accommodated, and having a tubular rear extension 35 in which the stem 4 of the refill unit 1 is slidably Guided. The rear end wall 13 of the seal cavity forms a rearwardly facing shoulder 36 extending about the tubular extension 35 for abutment by the forward end of a return spring 21. As with previous embodiments, the sealing device may be positioned on the refill unit 1 for the seal 8 to close off the writing tip 3 from ambient atmosphere before and after the refill unit is installed within the writing instrument.

The described refill units 1 can in accordance with the invention be supplied and sold to customers in combination with replacement seals 8. In such cases, as the seal 8 needs to remain effective only for as long as the supply of ink within a refill lasts, there is greater flexibility available as regards the seal design and as a result it is possible to ensure a more reliable sealing of the writing tip than if the same seal arrangement was required to last the same full useful lifetime as those parts not intended to be replaced periodically. Furthermore, the seal may be of simple construction and economic to manufacture. The sealing device 11 can be associated with the refill unit 1 so that both can be replaced as a single sub-assembly, and the sealing device 11 can also serve to seal the writing tip from ambient atmosphere during the period from manufacture of the refill unit to installation in a writing instrument barrel.

The particular embodiments described in detail above are given by way of non-limiting example only. Modifications and changes can be made within the spirit and scope of the invention and it is our intention to be limited only by the appended claims.

What is claimed is:

1. A marking instrument comprising a barrel, a marking unit including a marking tip and a marking fluid reservoir disposed in the barrel and replaceable therein, a retraction mechanism for advancing and retracting the marking unit for moving the marking tip between a waiting position projecting through an opening at the forward end of the barrel and an inoperative position within the barrel, a toroidal seal member for closing off the retracted marking tip from the barrel opening when the marking tip is retracted, wherein the seal is replaceable with a removable seal holder and is arranged to roll between the seal holder and marking tip during movement of the marking tip between the writing and inoperative positions.

2. A marking instrument according to claim 1, wherein the seal member is received in a cavity in the seal holder.

3. A marking instrument according to claim 2, wherein the seal cavity has at least one end wall formed by the seal holder, the end wall(s) limiting the movement of the seal within the barrel.

4. A marking instrument according to claim 1, wherein a forward end portion of the barrel is detachable for replacing the seal.

5. A marking instrument according to claim 4, wherein the detachable forward end portion of the barrel houses the seal and constitutes the removal seal holder.

6. A marking instrument according to claim 1, wherein the seal holder is removably received in the barrel at the forward end thereof.

7. A marking instrument according to claim 1, wherein the seal holder is connected to the marking unit for the seal and marking unit to be replaced in the barrel together.

8. A marking instrument according to claim 7, wherein the seal holder includes a tubular portion in which the marking unit is slidably guided.

9. A marking instrument according to claim 1, wherein the seal holder defines a spring chamber for housing a return spring acting on the marking unit to urge the marking unit to the retracted position.

10. A marking instrument according to claim 9, wherein the return spring is held in the spring chamber between a rearwardly directed shoulder defined behind the seal and a forwardly directed shoulder on the marking unit.

11. A marking instrument according to claim 10, wherein the forwardly directed shoulder is formed by a flange, and the flange is captive within the spring chamber, whereby the marking unit, the seal, the seal holder and the spring are replaceable as a unit.

12. A refill unit for a retractable marking instrument that includes a barrel for receiving the refill unit and a retraction mechanism for advancing and retracting the refill unit axially relative to the barrel, the refill unit comprising: a marking tip, a reservoir containing marking fluid for delivery to the marking tip, and a toroidal sealing device which is arranged to seal around the marking tip when the sealing device and refill unit are installed in the retractable marking instrument and the marking tip is retracted.

13. A refill unit for a marking instrument, comprising a marking tip and a reservoir containing marking fluid for delivery to the marking tip, and a toroidal sealing device arranged to seal the marking tip from ambient atmosphere for preventing dry out before and after the refill unit has been inserted into the marking instrument.

14. A refill unit according to claim 13, wherein the sealing device is disposed within a seal holder.

15. A refill unit according to claim 14, wherein the seal holder defines a seal cavity with end walls between which the seal is able to roll during movement of the marking tip through the seal.

16. A refill unit according to claim 14, wherein the seal holder has the form of a replaceable forward end portion of a marking instrument barrel.

17. A refill unit according to claim 14, wherein the seal holder defines a spring chamber in which a return spring for urging the refill unit rearwardly is accommodated.

18. A refill unit according to claim 17, wherein the spring acts between a front shoulder defined by the seal holder, and a flange fixed on the refill unit, the flange being held captive by the seal holder to avoid separation of the refill unit and seal holder.

* * * * *